US006899014B2

(12) United States Patent
Dawson

(10) Patent No.: US 6,899,014 B2
(45) Date of Patent: May 31, 2005

(54) HYDRAULIC HOIST FORMED FROM MEMORY ALLOY

(75) Inventor: Steven Clare Dawson, Phelpston (CA)

(73) Assignee: Dawson Hydraulics Inc., Barrie (CA)

( * ) Notice: Subject to any disclaimer, the term of this patent is extended or adjusted under 35 U.S.C. 154(b) by 35 days.

(21) Appl. No.: 10/361,862

(22) Filed: Feb. 11, 2003

(65) Prior Publication Data

US 2003/0167912 A1 Sep. 11, 2003

(30) Foreign Application Priority Data

Feb. 12, 2002 (CA) ..... 2371380

(51) Int. Cl.[7] ..... F01B 7/20
(52) U.S. Cl. ..... 92/52
(58) Field of Search ..... 92/52, 53

(56) References Cited

U.S. PATENT DOCUMENTS

| | | | | |
|---|---|---|---|---|
| 3,958,376 A | | 5/1976 | Campbell | 52/115 |
| 4,471,944 A | | 9/1984 | Leray et al. | 254/93 R |
| 4,928,488 A | | 5/1990 | Hunger | 60/480 |
| 5,322,004 A | | 6/1994 | Sims | 92/52 |
| 5,390,586 A | | 2/1995 | Jones | 92/79 |
| 5,400,695 A | | 3/1995 | Walker | 92/128 |
| 5,562,393 A | | 10/1996 | Focke et al. | 414/626 |
| 5,983,778 A | * | 11/1999 | Dawson | 92/52 |
| 6,450,083 B1 | * | 9/2002 | Dawson | 92/53 |

OTHER PUBLICATIONS

Aluminum 7005–T53, MatWeb.com.*

* cited by examiner

*Primary Examiner*—Edward K. Look
*Assistant Examiner*—Michael Leslie
(74) *Attorney, Agent, or Firm*—Dimock Stratton LLP; Mark B. Eisen

(57) ABSTRACT

A telescoping hydraulic hoist with tube stages formed from a heat treated aluminum alloy from one of the series 2000, 6000 or 7000 aluminum alloys. These alloys retain good "memory" properties, and under the force of a pressure spike undergoes a momentary elastic deformation which acts as a shock absorber, expanding the tube wall to absorb the peak stresses and resist buckling. The hoist of the invention is thus much lighter than a comparably rated steel hoist, and much more resistant to corrosion.

4 Claims, 1 Drawing Sheet

HYDRAULIC HOIST FORMED FROM MEMORY ALLOY

FIELD OF THE INVENTION

This invention relates to hydraulic hoists. In particular, this invention relates to a hydraulic hoist in which the walls of the tube stages are formed from a memory alloy.

BACKGROUND OF THE INVENTION

Heavy duty telescoping hydraulic hoists, such as are commonly used in dump trucks and the like, are typically composed of steel. Steel is a strong, relatively rigid metal which, when formed to a suitable wall thickness, provides the necessary support for the hoist and its load, and operates effectively under the extremely high hydraulic pressures to which such devices are subjected.

However, steel is also very heavy, which reduces the efficiency of vehicles such as dump trucks that have to carry the hoist when transporting a load. Moreover, steel corrodes at a fairly high rate, which reduces the life of the rings and seals that are used to contain the hydraulic fluid and to ensure that the stages move freely relative to one another, and reduces the durability of the hoist components in general.

It would accordingly be advantageous to construct a telescoping hydraulic hoist from a non-corrosive material which is lighter than steel. This would considerably reduce the weight of the hoist and significantly extend the useful life of many of its components. However, pure aluminum is too soft and weak to support the type of load that such hoists are designed to lift.

Aluminum alloys, which include an alloy composed of at least 75% aluminum and containing one or more other metallic elements such as copper, manganese, magnesium, silicon, zinc, and/or lithium, can be considerably stronger than pure aluminum. The additional metallic elements are known to substantially improve many mechanical characteristics of the alloy over pure aluminum, including its strength, particularly in the case of heat treatable aluminum alloys which can be processed to have a strength comparable to that of steel. However, the modulus of elasticity of aluminum is typically around one-third of the modulus of elasticity of steel. It is commonly believed that even heat treated aluminum alloys would deform under stresses which would not affect steel, causing the hoist to buckle under peak stresses which can be encountered during normal operation, and especially if the hoist malfunctions or if it is operated in an abusive or careless fashion.

In the heavy duty hydraulic hoist industry buckling is a major concern, and the low modulus of elasticity of aluminum alloys has resulted in the universal perception that such alloys are unsuitable for use in heavy-duty hydraulic cylinders. This perception includes low buckling point, and an inability to withstand the severe shocks, stresses and spikes in pressure that such hydraulic cylinders are subject to especially when used for dump trucks and other similar high stress applications. It is accordingly conventionally believed that such materials are unsuitable for use in heavy duty hydraulic hoist applications. As a result there are no heavy-duty aluminum hydraulic cylinders available in the market, although aluminum is in common use for light duty applications.

On the other hand, it is also common knowledge that in certain industries (such as the trucking industry), any significant reduction weight is extremely valuable because it increases available payload, and reduces fuel consumption and wear and tear on the vehicle. If it is proven to be feasible to construct heavy duty hydraulic hoists from high strength aluminum alloys, the weight saving over comparable steel hoists that are currently the standard would be substantial, potentially running into hundreds of tons. In addition, because aluminum does not rust, such a cylinder offers a significant environmental benefit since it would be feasible to employ a water based hydraulic medium that is environmentally friendly and less expensive than oil.

SUMMARY OF THE INVENTION

The present invention provides a telescoping hydraulic hoist composed of an aluminum alloy. The hoist of the invention is thus much lighter than a comparably rated steel hoist, and much more resistant to corrosion.

The aluminum alloy is preferably a 2000, 6000 or 7000 series aluminum alloy, which are heat treatable to increase tensile and yield strengths. The modulus of elasticity in such alloys remains essentially unchanged from pure aluminum, so that these alloys retain good "memory" properties, but are also more readily deformable than steel. As such aluminum alloys are considered unsuitable for use in heavy duty hydraulic hoist applications because of the extremely high loads and pressures involved.

However, the applicant has discovered that the lower modulus of elasticity which would ostensibly render aluminum alloys unsuitable for use in a telescoping hydraulic hoist, is in fact advantageous. The "memory" in such materials as 2000, 6000 and 7000 series aluminum alloys allows the walls of the hoist stages to expand in response to pressure spikes, and thus to absorb peak stresses more effectively than a steel hoist. It is believed that rather than buckling or deforming under such stresses, the hoist of the invention accommodates pressure spikes by momentary elastic response. The sudden surge in force causes a rapid expansion in the walls of the tube stages, which because of their elasticity are able to absorb much of the momentary energy spike. This is followed by a rapid contraction of the tube stage walls when the stress is removed at which point the tube stages, because of the memory of the alloy, return to their original shape and the hoist can continue to operate without any deleterious effects.

The invention thus provides a telescopic multi-stage hydraulic hoist, comprising: an outer stage tube having one end sealed by a base member and an open end, and having a wall formed from a heat treated aluminum alloy; at least one additional tube stage disposed within the open end of said first stage tube such that there is an overlap between said tube stages, said at least one additional tube stage having a wall formed from an aluminum alloy from one of the series 2000, 6000 or 7000 aluminum alloys; a hydraulic fluid port in communication with an interior of the tube stages; and at least one seal mounted between tube stages, whereby forcing hydraulic fluid into said hydraulic fluid port causes said at least one additional tube stage to extend relative to said outer tube stage; whereby the walls of said tube stages have a modulus of elasticity which allows the tube stages to expand under the force of a momentary pressure spike, and upon release of the pressure spike, to retract to their original configuration.

In further aspects of the preferred embodiment: the hoist s selected from one of the series 2000, 6000 or 7000 aluminum alloys, preferably a 70005-T53 aluminum alloy; and the tube stages have a wall thickness of ½ inch or less.

BRIEF DESCRIPTION OF THE DRAWINGS

In drawings which illustrate by way of example only a preferred embodiment of the invention.

DETAILED DESCRIPTION OF THE INVENTION

Figure 1:
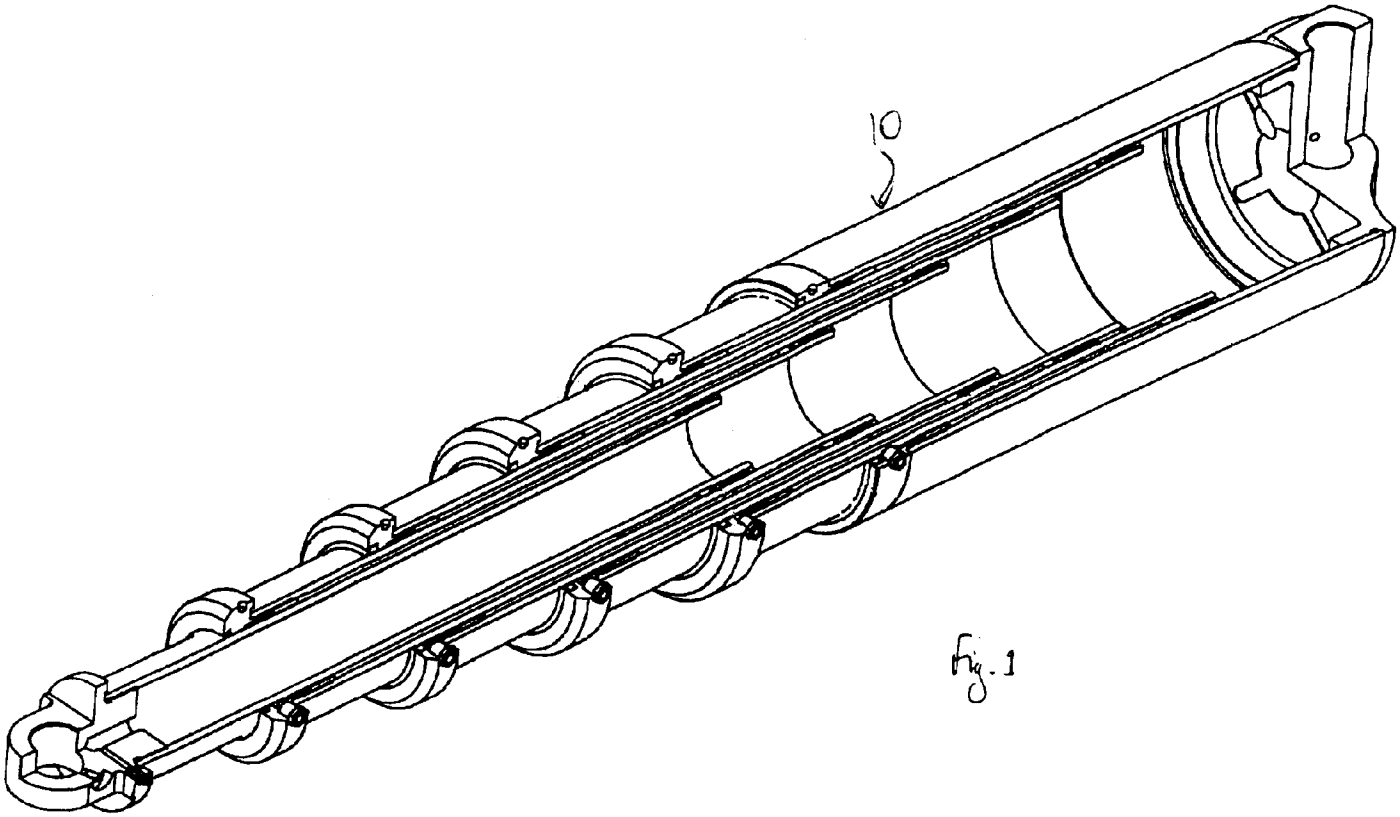
FIG. 1 is a partly cutaway perspective view of a hoist according to the invention.
Figure 2:
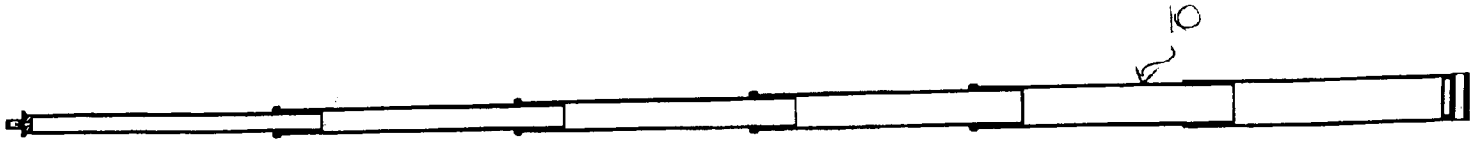
FIG. 2 is a schematic view of the hoist of FIG. 1 in an extended condition.

FIGS. 1 and 2 illustrate a hoist 10 according to the invention. By way of example only, the hoist 10 shown is constructed and operates in a manner similar to that shown and described in the inventor's PCT Patent Application No. PCT/CA02/00021 filed Jan. 7, 2002 and U.S. Pat. No. 6,450,083 issued to the present applicant on Sep. 17, 2002, both of which are incorporated herein by reference. However, the invention is applicable to any heavy duty telescoping hydraulic hoist, whether for use in a dump truck or the like, or for any other high load-bearing application, and the invention is not restricted to the particular embodiment illustrated in the drawing.

The walls of the tube stages forming the hoist 10 of the invention are composed of a memory alloy, preferably a heat treated aluminum alloy from one of the series 2000, 6000 or 7000 aluminum alloys, and most preferably 7005 aluminum alloy and especially 70005-T53.

Certain aluminum alloys, particularly the 2000, 6000 and 7000 series, are heat treatable and can thus be processed to have a strength comparable to steel. However, the modulus of elasticity remains relatively constant even after processing, so that the heat treated aluminum alloy is considerably more elastic than steel, often referred to as "memory."

The modulus of elasticity of a material is a measure of a stress applied to the material divided by strain, within the elastic range of the material. The strain is the ratio of the amount of deformation caused by the stress to the initial length of the material. Therefore, a material which stretches more under a given stress has a lower modulus of elasticity.

Since the modulus of elasticity of aluminum is typically around one-third the modulus of elasticity of steel, under a given stress the ratio of the amount of deformation of the tube wall to the initial length of the tube stage is approximately three times greater for the aluminum alloy than for steel. Accordingly, conventional engineering principles would dictate that if the tube stages were formed from a memory material, such as a 2000, 6000 or 7000 series aluminum alloy, the wall thickness would have to be considerably greater than that of a conventional steel tube stage in order to compensate for the substantially lower modulus of elasticity of the memory material.

However, the applicant has discovered that the lower modulus of elasticity is actually advantageous, and allows a heavy duty hydraulic hoist 10 to be constructed from a memory material such as a 2000, 6000 or 7000 series aluminum alloy without having to substantially increase the thickness of the tube stage walls over the thickness of its steel counterpart proportioniate to the difference in the modulus of elasticity.

The 2000, 6000 and 7000 series of aluminum alloys are classes of high strength aluminum alloys which have a substantially higher tensile and yield strengths than ordinary aluminum. However, all aluminum, including its high strength alloys, has a modulus of elasticity in the same general range (approximately one third that of steel). In a test of the relative buckling strength of an aluminum alloy tube, the smallest tube stage in a telescopic hydraulic hoist 10 constructed from high strength aluminum alloy components was compared with a steel tube which is used in a typical steel telescopic hoist of equivalent site and load specification. An apparatus was designed and constructed to apply incremental force in a uniform way to each tube until it failed, and to accurately measure the amount of force required to reach the failure.

This test was devised to investigate the theory that the low modulus of elasticity of aluminum would not be a source of weakness for the tube stages under conditions of extreme stress and pressure, but instead would have the very opposite effect and would enhance the ability of the tube stages to deal with such conditions provided the tensile and yield strength of the tube was high enough. This is believed to be in part due to the fact the when the hoist 10 is in operation it is filled with hydraulic fluid under considerable pressure, which itself forms a strong rigid column and which plays a key role in complementing the strength of the tube walls themselves, providing added strength to resist failure as well as providing the force required to move the load. Tubes constructed from these classes of high strength aluminum alloys have sufficient tensile strength to contain the pressure levels which the hydraulic fluid has to attain for the heavy duty hoist to function safely.

The tubes selected for the test were the smallest aluminum alloy tube (inner stage) used in a working prototype of a hydraulic hoist 10 formed from the 7000 series of high strength aluminum alloys, namely 70005-T53, and the smallest tube used in the construction of a typical heavy duty, 265 inch stroke, five stage telescopic hydraulic cylinder, with a base that is between 10-¼ inside diameter and 10-½ inches in outside diameter. The steel tube was 60 inches long with an outside diameter of 4 inches, a wall thickness of ¼ inch (which is the most common tube wall thickness for heavy duty steel hydraulic cylinders) and a weight of 50 pounds. The aluminum alloy tube was 60 inches long with an outside diameter of 4-⅜ inches, a wall thickness of 7/16 inches (a ⅜ inch wall has been shown to have sufficient strength for all the moving tube stages, but the smallest tube was given a wall thickness of 7/16 inches for an increased margin of safety) and a weight of 32 pounds.

One of the most significant features of high strength aluminum alloys in this context is that they have a memory, and when bent or pulled apart have a strong tendency to return to their original shape. This is a direct function of the modulus of elasticity and yield strength. Typical hydraulic cylinder steel is more rigid because of its higher modulus of elasticity, but because of lower yield strength does not possess this quality. The applicant's theory is that the lower modulus of elasticity and high strength of aluminum alloy would result in its being superior to steel in withstanding severe stresses and spikes in pressure because the lower modulus of elasticity gave it the ability to expand in order to absorb and diminish the impact of such shocks and to contract back to its original shape when the shock ceased. In order for the aluminum alloy hoist 10 to achieve a level of strength equivalent to steel for a particular application, it may be beneficial to use moderately thicker walls for the aluminum tubes. The precise dimensions of the aluminum tube wall thickness is determined by the tensile and properties of the particular high strength alloy of aluminum which is selected for the particular application.

In order to test this theory the ends of the respective aluminum and steel tubes were plugged with a cap and 'O' ring and then placed in an apparatus specifically designed and constructed for the purpose of the test. The apparatus consisted of a stationary steel plate at one end and a steel plate at the opposite end, which was pushed along a slide beam by a large hydraulic cylinder. Each end of the tube to be tested was placed in a spherical bracket which was attached to the steel end plates and which swiveled in order to ensure that the force was applied uniformly to each tube. Each tube was pressurized to 2000 psi and the large hydraulic push cylinder was activated to apply the force required to cause failure. A pressure gauge was connected to each tube to monitor the pressure in the tube throughout the test. The amount of force was measure on a calibrated 250-ton strain gauge. Although the thickness of the tube wall on the aluminum alloy tube was greater than the thickness of the wall of the steel tube, an equivalent size heavy duty telescopic hydraulic hoist constructed from steel with five moving stages, a 265 inch stroke and a 10-¼ inch base weighs approximately 1,100 pounds, whereas a prototype aluminum alloy hoist 10 of comparable size weighs 385 pounds.

The aluminum alloy tube was tested first, and failed at a force of 108 tons. The failure mode was a bow near the centre of the tube. The steel tube was tested next, and failed at a force of 100 tons, with a similar failure mode (bow fashion). This result is contrary to conventional beliefs. The applicant postulates that the deformation of the aluminum alloy acts as a shock absorber in response to a pressure spike, expanding the tube wall to absorb the peak stresses. The tube stages thus resist buckling under the force of the pressure spike, and it is believed that this is at least in part because the shock of a sudden bending or twisting force is distributed throughout the entire hoist 10, and absorbed by the elastic response of the tube stage walls. Also, as noted above, the tube stages are filled with hydraulic fluid which, when subjected to the peak stress that causes the walls of the tube stages to expand, rigidities the hoist 10 from inside the tube stages, effectively giving the hoist 10 the rigidity of a solid rod for the brief duration of the momentary pressure spike. These factors result in a hoist 10 formed from a memory material such as a 2000, 6000 or 7000 series heat treated aluminum alloy having strength and stability substantially equivalent to that of a steel hoist of comparable wall thickness.

Thus, the applicant has discovered that despite the apparent unsuitability of aluminum alloys with conventional wall thicknesses for use in heavy duty hydraulic hoist applications, the 2000, 6000 and 7000 series of aluminum alloys are comparable to or superior to steel in withstanding severe stresses and pressure spikes, because the lower modulus of elasticity gives them the ability to expand in order to absorb and diminish the impact of such shocks.

The applicant has advanced suggestions and theories for the discovery that, contrary to conventional beliefs, memory alloys such as certain aluminum alloys are suitable for use in heavy duty hydraulic hoists designed with a conventional wall thickness, despite the extremely high loads and pressures involved. However, the applicant does not guarantee that the explanations offered for this discovery are correct accurately explain the reasons for the phenomenon.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A telescopic multi-stage hydraulic hoist, comprising:

an outer stage tube having one end sealed by a base member and an open end, and having a wall formed from an aluminum alloy from one of the series 2000, 6000 or 7000 aluminum alloys;

at least one additional tube stage disposed within the open end of said outer stage tube such that there is an overlap between said tube stages, said at least one additional tube stage having a wall formed from a heat treated aluminum alloy;

a hydraulic fluid port in communication with an interior of the tube stages; and at least one seal mounted between tube stages, whereby forcing hydraulic fluid into said hydraulic fluid port causes said at least one additional tube stage to extend relative to said outer tube stage;

whereby the walls of said tube stages have a modulus of elasticity which allows the tube stages to expand under the force of a momentary pressure spike, and upon release of the pressure spike, to retract to their original configuration.

2. The hoist of claim 1, wherein the alumimum alloy is selected from a 7005 aluminum alloy.

3. The hoist of claim 2 wherein the aluminum alloy is 7005-T53.

4. The hoist of claim 1 wherein the tube stages have a wall thickness of ½ inch or less.

* * * * *